United States Patent [19]

Middleton

[11] Patent Number: 4,987,612

[45] Date of Patent: Jan. 29, 1991

[54] CAPE FOR A NURSING MOTHER

[76] Inventor: Teresa L. Middleton, 2134 SE. Ohio, Rosenburg, Oreg. 97470

[21] Appl. No.: 484,269

[22] Filed: Feb. 26, 1990

[51] Int. Cl.[5] ..... A41D 1/20; A41D 3/08; A41B 9/00

[52] U.S. Cl. ..... 2/104; 2/88; 2/114

[58] Field of Search ..... 2/104, 88, 114, DIG. 7

[56] References Cited

U.S. PATENT DOCUMENTS

| | | | |
|---|---|---|---|
| 2,075,238 | 3/1937 | Stephens et al. | 2/88 |
| 2,144,875 | 1/1939 | Forrest | 2/88 |
| 4,567,611 | 2/1986 | Kendrick | 2/104 |
| 4,571,743 | 2/1986 | Wagoner | 2/114 |
| 4,771,480 | 9/1988 | Stimson et al. | 2/DIG. 4 |

FOREIGN PATENT DOCUMENTS

| | | | |
|---|---|---|---|
| 2604065 | 3/1988 | France | 2/88 |

*Primary Examiner*—Werner H. Schroeder
*Assistant Examiner*—Gloria Hale
*Attorney, Agent, or Firm*—James D. Givnan, Jr.

[57] ABSTRACT

A garment for nursing mothers and having arm holes and partially overlapped fabric members which may be draped individually over the nursing infant. A neckband may be closed about the neck in a removable manner. Rear edges of the fabric members terminate rearward of the wearer in a spaced apart manner while frontal edges of the fabric members terminate on opposite sides of a medial plane of the garment to provide overlapped portions for infant concealment.

6 Claims, 1 Drawing Sheet

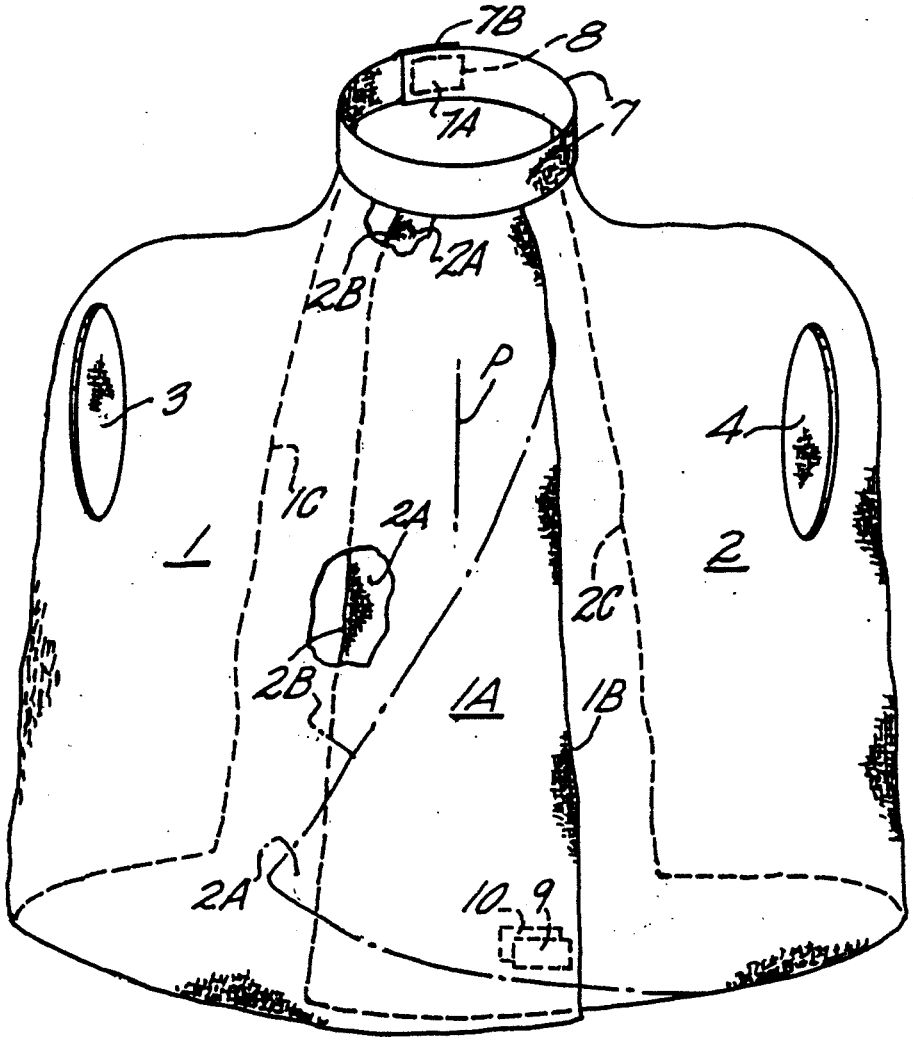
7B
8
7A
7
2A
2B
P
3
4
1C
2A
1
2
2C
2B
1A
1B
2A
10
9

CAPE FOR A NURSING MOTHER

BACKGROUND OF THE INVENTION

The present invention pertains generally to an article of clothing providing privacy to a mother during nursing of an infant in a public area.

Various articles of apparel have been directed toward providing a mother with a degree of privacy while nursing an infant in public. For the most part, such articles of clothing are not readily donned by the wearer in an unobtrusive manner but rather are garments intended for wear throughout the day. Examples of such prior art attire are found in U.S. Pat. Nos. 4,144,593; 4,566,136; 4,601,068; 4,660,227; 4,663,782; 4,567,611; and 4,458,365. Additionally found in the prior art are full length garments not intended for wear only when nursing.

SUMMARY OF THE PRESENT INVENTION

The present invention is embodied within a cape which may be put on, as well as removed, by the wearer in an inconspicuous manner to permit nursing of an infant in public areas.

The present article of attire is in the nature of a cape to facilitate donning and removal of the article even while the wearer remains seated, as for example, in a restaurant or public conveyance such as a commercial aircraft. The cape includes fabric members each of which drape over the back and sides of the upper torso and include wide lapping portions located centrally of the frontal torso. The fabric members depend from a neckband which includes closure means contributing towards convenient use of the cape. The fabric members provide relatively large overlapped areas of fabric that conceal the infant from view during nursing. The fabric members may be joined adjacent their lower extremities to permit the mother to secure the fabric members against accidental displacement by the infant. The cape may be advantageously formed from a low cost material such as paper or plastic film so as to be disposable.

Important objectives of the present article of attire include the provision of a garment lending itself to being put on, as well as removed, while the user remains seated; the provision of an article of cape configuration having a pair of fabric members enclosing the sides and front of the upper torso with relatively large overlapped areas for at least partial concealment of the infant during nursing; the provision of an article of attire having a neckband with closure means for attachment about the neck with the article preferably being sleeveless to facilitate donning and removal.

BRIEF DESCRIPTION OF THE DRAWINGS

In the accompanying drawings, the FIGURE is a frontal perspective view of the present garment.

DETAILED DESCRIPTION OF THE PREFERRED EMBODIMENTS

With continuing attention to the drawings wherein applied reference numerals indicate parts similarly hereinafter identified, the reference numerals 1 and 2 indicate fabric members covering the front sides and lateral rear portions of the mother's upper torso.

Each fabric member defines an arm hole at 3 and 4 which is of a size to permit convenient arm insertion and removal. Outer and inner overlapping portions 1A and 2A of the fabric members are located centrally of the frontal upper torso and terminating at edges 1B–2B oppositely offset from a vertical medial plane P of the garment. The overlapped areas may be overlapped approximately five inches or so in a horizontal direction to provide an adequate expanse of material to partially cover the infant during nursing. Fabric members 1 and 2 terminate rearwardly of the torso at edges 1C and 2C.

A neckband at 7 has detachable end segments at 7A and 7B provided with cooperating fabric closure strips as at 8 or other suitable closure means including segments to permit convenient fastening of the neckband about the neck.

The fabric members 1 and 2 are attached to the neckband and, accordingly, are free to be displaced away from the wearer's body in radical fashion to be draped over the infant.

If so desired, the mother may join the lowermost extremities of the overlapped portions 1A and 2A by means of suitable closure means such as fabric closure strips 9 and 10 in place thereon.

Use of the garment is believed understood from the foregoing description and shown in the drawing, inner overlapping portion 2A may be temporarily extracted and placed in the outer or broken line position and draped over the infant during nursing from the mother's left side. Oppositely, outer overlapping portion 1A may be displaced away from the torso to permit positioning of the infant between outer and inner overlapping portions 1A–2A.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. A cape for wear during the nursing of an infant in public, said cape comprising, a neckband adapted for securement about the neck, and pliable members integral with the neckband each having front and side portions for overlying the upper torso of the wearer, said members each defining an arm hole, said pliable members having mutually overlapping frontal portions extending substantially the length of the cape, said pliable members additionally including back portions which when the cape is worn terminate in horizontally spaced apart upright edges to facilitate both donning and removal of the cape.

2. The claim claimed in claim 1 wherein said overlapping frontal portions each terminating in an edge oppositely horizontally offset from a vertical medial plane of the cape.

3. The cape claimed in claim 2 wherein said frontal portions overlap in a horizontal direction approximately five inches.

4. The cape claimed in claim 1 wherein said pliable members are of cellulose material.

5. The cape claimed in claim 1 wherein said pliable members are of synthetic film material.

6. The cape claimed in claim 1 wherein said neckband has end segments and fabric closure strips mounted on said end segments.

* * * * *